United States Patent [19]

Steinhilber

[11] 4,285,607

[45] Aug. 25, 1981

[54] APPARATUS FOR FEEDING SINGLE SHEETS FROM A MAGAZINE TO THE PRINTING CYLINDER OF A PRINTING OFFICE MACHINE OR DATA PROCESSING MACHINE AND FOR STACKING THE SINGLE SHEETS ARRIVING FROM THE PRINTING CYLIDER

[76] Inventor: Helmut Steinhilber, Königstr. 47, 7210 Rottweil, Fed. Rep. of Germany

[21] Appl. No.: 115,389

[22] Filed: Jan. 25, 1980

[30] Foreign Application Priority Data

Feb. 10, 1979 [DE] Fed. Rep. of Germany ..... 2905171

[51] Int. Cl.[3] ..... B41J 11/58; B41J 13/10

[52] U.S. Cl. ..... 400/625; 400/629; 270/58; 271/4; 271/9; 271/127; 271/305; 101/232

[58] Field of Search ..... 400/625, 624, 629; 271/9, 305, 127, 303, 7, 4; 270/58; 355/3 SH, 14 SH; 101/232, 236, 237, 238

[56] References Cited

U.S. PATENT DOCUMENTS

| | | | |
|---|---|---|---|
| 2,528,420 | 10/1950 | Carroll | 400/625 |
| 3,378,251 | 4/1968 | Donabin | 271/3 |
| 3,641,931 | 2/1972 | Hickox et al. | 271/303 |
| 4,062,533 | 12/1977 | Greenberg et al. | 271/4 |
| 4,078,789 | 3/1978 | Kittredge et al. | 271/186 |
| 4,098,501 | 7/1978 | Tani | 271/127 |

*Primary Examiner*—Edgar S. Burr
*Assistant Examiner*—C. A. Pearson
*Attorney, Agent, or Firm*—Blair, Brown & Kreten

[57] ABSTRACT

The invention relates to an apparatus for feeding and stacking single sheets for a printing office machine. Singel sheets (32) may be selectively called up from a plurality of magazine units (30), which are disposed vertically one after another. The single sheets are guided to the printing cylinder (12) by way of a horizontally disposed feed-in conveyor track (20) traveling below the magazine unit (30). The printed single sheets are stacked in sorted fashion in stacking receptacles (70) by way of a horizontally disposed delivery track (66,68) provided with controllable delivery diverters (72) and traveling below the feed-in conveyor track (20), the stacking receptacles (70) being disposed vertically one after another below the delivery track. The induction channel leading from the feed-in conveyor track (20) to the printing cylinder (12) crosses the ejection channel leading from the printing cylinder (12) to the delivery track (66,68). The apparatus according to the invention makes it possible to dispose a large number of magazine units (30) and stacking receptacles (70) in a space-saving manner.

16 Claims, 2 Drawing Figures

APPARATUS FOR FEEDING SINGLE SHEETS FROM A MAGAZINE TO THE PRINTING CYLINDER OF A PRINTING OFFICE MACHINE OR DATA PROCESSING MACHINE AND FOR STACKING THE SINGLE SHEETS ARRIVING FROM THE PRINTING CYLIDER

BACKGROUND, OBJECTS AND SUMMARY OF THE INVENTION

The invention relates to an apparatus for feeding single sheets from a magazine to the printing cylinder of a printing office machine or data processing machine and for stacking the single sheets arriving from the printing cylinder, having a feed-in conveyor track disposed substantially horizontally and leading to the printing cylinder, having an induction channel leading from the feed-in conveyor track to the induction side of the printing cylinder and an ejection channel leading from the ejection side of the printing cylinder to a delivery track, wherein the delivery track comprises guide foils with driven conveyor rollers, and having advancement rollers driven in the induction channel and in the ejection channel of the sheet guide.

An apparatus of this kind is known from U.S. Pat. No. 2,528,420. In this known apparatus, single sheets are transported from a magazine into the induction channel of the printing cylinder by way of the feed-in conveyor track, are drawn in by the printing cylinder and are transported after being printed upon into a stacking unit by way of the delivery track.

The apparatus has only one magazine, so that only a single kind of single sheets can be fed. If different kinds of single sheets are to be printed, for instance different forms or different stationery, then the stack of paper in the magazine must be removed and exchanged for a different stack, which is annoying and wastes time.

Furthermore, in this apparatus, all the single sheets ejected by the printing cylinder, which have been printed upon, are set aside in a common stacking unit. If the printed single sheets are to be further processed in different ways, for instance if they are to be directed to different workers, different receptacles, or different departments in an organization, then sorting the single sheets in the stack is necessary, which is tiresome and wastes time.

It is accordingly an object of the invention to improve the apparatus of the type described above in such a manner that a larger number of different single sheets, stored in one magazine, can be selectively fed to the printing cylinder in a simple manner and it is possible to stack the printed single sheets in a sorted fashion.

This object is attained in accordance with the invention by means of at least two magazine units containing the single sheets guided substantially vertically, which are disposed above the feed-in conveyor track one after another in the feed direction and provided with separately controllable separation devices, by means of a delivery track disposed below the feed-in conveyor track and leading away from the printing cylinder, furthermore by means of at least two stacking units stacking the single sheets substantially vertically, which are disposed below the delivery track one after another in the direction of delivery, by means of diverters known per se and separately controllable provided in the delivery track and by means of an ejection channel crossing the induction channel in the sheet guide.

Advantageous realizations and further embodiments of the invention are disclosed in the dependent claims.

With the apparatus in accordance with the invention it is possible to keep in readiness a large number of various kinds of single sheets or single forms stored in the magazine, the single sheets being selectively feedable. To this end, a plurality of magazine units is available, of which each one can store one stack of a particular kind of single sheet. The separation devices of the magazine units can be controlled separately, for instance by the office machine, so that one single sheet of the kind needed at a particular time is called up from the appropriate magazine and fed to the printing cylinder by way of the feed-in conveyor track.

Because the single sheets are fed from the magazine units by way of the horizontal feed-in conveyor track, there is no limitation in principle as to the number of magazine units disposed vertically and located one after another. A limitation in the number of magazine units and thus of the different kinds of single sheets which can be held ready in stored fashion is caused only by the length of the feed-in conveyor track and thus by the structural dimensions of the apparatus.

An apparatus is known per se from the East German Pat. No. 109,572, wherein a multiplicity of magazine units containing single sheets is disposed one after another above a feed-in conveyor track in the feed direction and has separately controllable separation devices. However, this machine is a collating machine wherein single sheets are withdrawn in cyclical fashion, always in the same order, from the magazine units and put together to make a book signature, set of forms, or the like. The use of a multiplicity of magazine units with a horizontal feed-in conveyor track for the selective feeding of different kinds of single sheets in an office machine, however, is not anticipated by this collating machine.

As a result of the embodiment of the magazine units as cassettes which can be exchanged one for another, the number of different kinds of single sheets available for use can be increased despite the predetermined number of magazine units dictated by the length of the feed-in conveyor track, because individual cassettes can be exchanged for others in case of need.

A particular advantage results from the insertion of the cassettes in cassette holder units, which can be inserted separately into the apparatus and which contain the separation device and its drive means. That is, the magazine can be equipped with a varying number of magazine units in modular fashion. The basic apparatus equipped with the feed-in conveyor track can be equipped, as needed, with a varying number of magazine units, and in like fashion further magazine units can be added to those already present, in order to adapt the apparatus to increasing demands placed upon it.

The drive of the separation apparatuses can be effected by means of the separately controllable drive motors which are separately disposed in the cassette holder units. It is also possible to effect the drive of the separation device by means of the feed-in conveyor track, so that separate drive motors become superfluous. In this case, the driving motion is taken over, for instance by a friction wheel or gear wheel of the cassette holder unit, from the feed-in conveyor track and transmitted via a gear to the separation device. The separate control of the separation device is effected by way of couplings inserted into the gear train.

The single sheets which have been printed upon and ejected from the printing cylinder are stacked in the various stacking units in a sorted fashion by way of the delivery track and its separately controllable diverters. By means of controlling the diverters, for instance by the office machine, the stacking is effected immediately in the desired stacking unit.

The stacking units are disposed as vertically disposed stacking receptacles below the delivery track, so that the number of stacking units is dependent only on the length of the delivery track.

The single sheets can fall into the stacking receptacles by their own weight, without additional conveyor rollers being required.

In an efficient manner, the stacking receptacles are disposed so as to make an acute angle counter to the direction of delivery, so that the single sheets directed into the stacking receptacles automatically come to rest with the printed side down. The stack of printed single sheets removed from the stacking receptacle is, as a result, already in the correct order, that is the order in which they were printed.

A delivery track with separately controllable delivery diverters and stacking receptacles disposed below the delivery track is known per se from the U.S. Pat. No. 2,668,706.

A decisive advantage of the apparatus according to the invention is that, because of the crossing of the induction channel and the ejection channel in the sheet guide at the printing cylinder, the feed-in conveyor track with the magazine units can be disposed directly above the delivery track with the stacking units. Even with a greater number of magazine units and stacking units, and thus an increased length of the feed-in conveyor track and of the delivery track, the outer dimensions of the apparatus thus remain such as to save space.

This could not be attained in accordance with prior art (compare U.S. Pat. No. 2,528,420). Because the ejection channel of the sheet guide is always located above the induction channel, then according to the prior art the delivery track as well must be located above the feed-in conveyor track at the sheet guide of the printing cylinder, and must lead upward in a direction deviating from the feed-in conveyor track, which wastes space and requires additional driven advancement rollers.

The additional stacking means provided in accordance with the invention above the printing cylinder makes it possible, as needed, to feed the printed single sheets after printing directly to this stacking means rather than to the delivery track. The single sheets can then be removed immediately from the stacker, so that it is not necessary to search for them in the stack arranged in order in the stacking units.

Furthermore, a sheet stacker can be disposed in advantageous fashion ahead of the forwardmost magazine unit just before the printing cylinder. By way of a diverter provided in the feed-in conveyor track and which can be changed in direction, the single sheets arriving from the magazine units can be delivered to the sheet stacker so as to be able to put together a set of forms from single sheets arriving from different magazine units. If the single sheets of the set of forms are placed in the desired number and order in the sheet stacker, then the set is again delivered to the printing cylinder from the sheet stacker, being controlled by a dispenser element.

The invention will be better understood and further objects and advantages thereof become more apparent from the ensuing detailed description of a preferred embodiment taken in conjunction with the drawings.

DESCRIPTION OF THE PREFERRED EMBODIMENT

Figure 1:
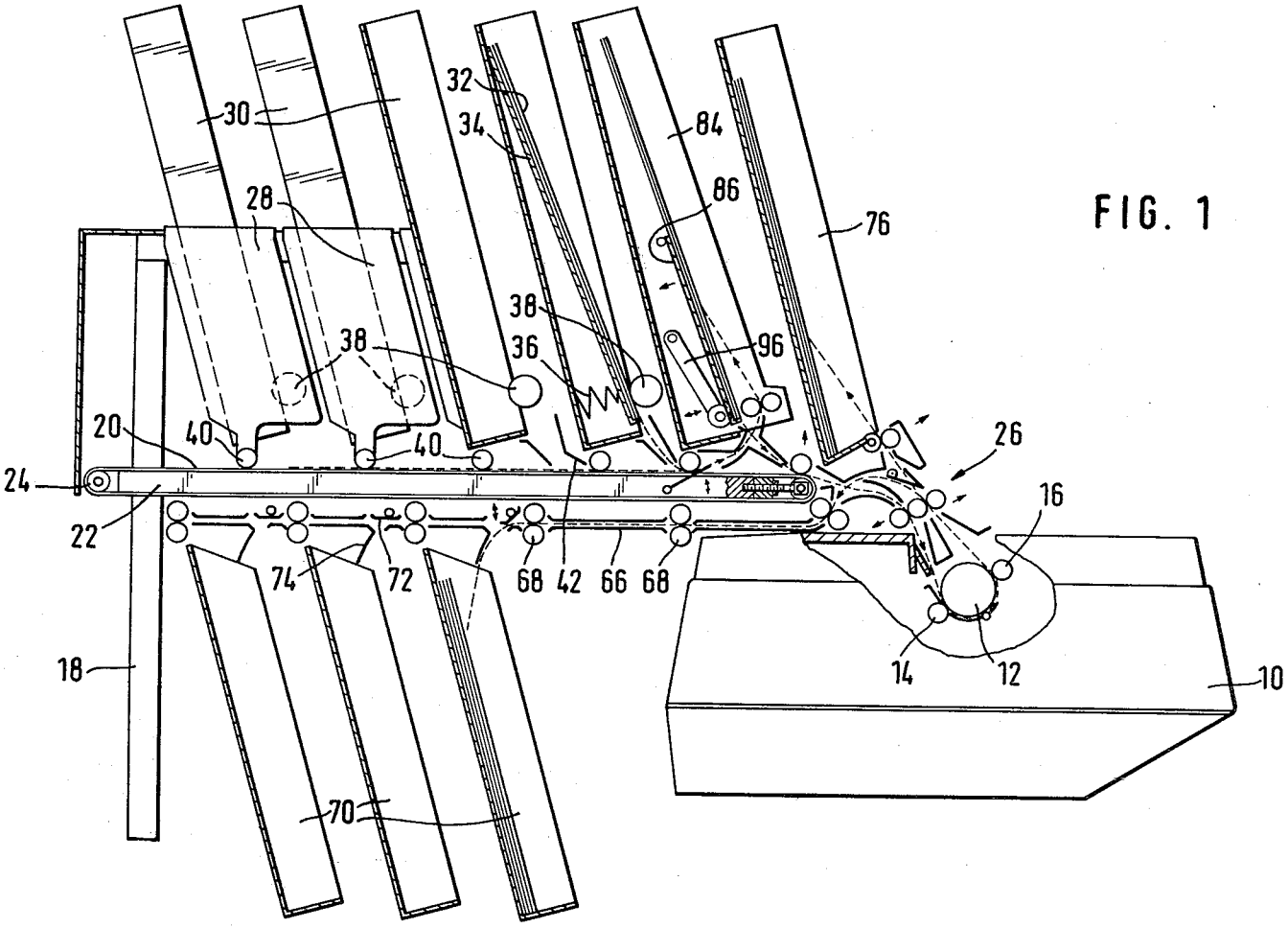
FIG. 1 is a schematic, partially cut-away side view of a printing office machine having an apparatus in accordance with the invention.

In the drawing, the apparatus for feeding and stacking single sheets is shown in combination with a printing office machine 10, of which only the printing cylinder 12 and the induction cylinders 14 and ejection cylinders 16, which are in contact with the printing cylinder, are shown as being essential to the invention.

The apparatus has a stand 18 to be attached to the office machine 10, which is shown only schematically in FIG. 1. A feed-in conveyor track is disposed horizontally in the stand 18 and embodied as an endlessly revolving conveyor belt 20. The conveyor belt 20 travels over a support plate 22 and is guided by two guide rollers 24, one of which is attached to the support plate 22 and adjustable in the longitudinal direction of the conveyor belt 20, as is shown more clearly in FIG. 2. The conveyor belt 20 is driven in a known manner, which is therefore not shown. The forward end of the conveyor belt 20 leads to a sheet guide 26 disposed at the printing cylinder 12, which is shown in detail in FIG. 2 and will later be described in detail.

Above the conveyor belt 20, cassette holder units 28 are inserted into the stand 18. The cassette holder units 28 (in FIG. 1, four such holder units are shown) are disposed substantially perpendicularly and one after another in the direction of travel of the conveyor belt 20. Exchangeable cassettes 30 are inserted into the cassette holder units 28, which receive stacks of the single sheets to be printed upon. As is shown in FIG. 1 for the cassette 30 which is furtherst forward, that is, on the right hand side, and shown in section, the stack 32 of single sheets lies on a plate 34 pivotably arranged in the cassette 30, which plate 34 is pressed under the effect of a spring 36 against the separation rollers 38 located in contact with the stack 32 of sheets.

The separation rollers 38 are supported in the cassette holder units 28 and are driven by means of the conveyor belt 20 via a gear train, not shown, by friction wheels 40 supported in the cassette holder units 28. A coupling is inserted into the gear train of the cassette holder units 28 which can be controlled by the office machine 10, so that one of the separation rollers 38 can be put into operation in selective fashion. In like manner, an electromotor can be provided in each cassette holder unit (28), by means of which the separation roller 38 is driven in a controlled manner. In this case as well, rollers 40 can be provided which hold the sheets in contact with the conveyor belt 20. Upon actuation of the separation roller 38 of one cassette holder unit 28, the sheets stored in the associated cassette 30 are fed to the conveyor belt 20 separately via a chute 42 of the cassette holder unit 28 and from there are delivered to the sheet guide 26, which will be described below in connection with FIG. 2.

Figure 2:
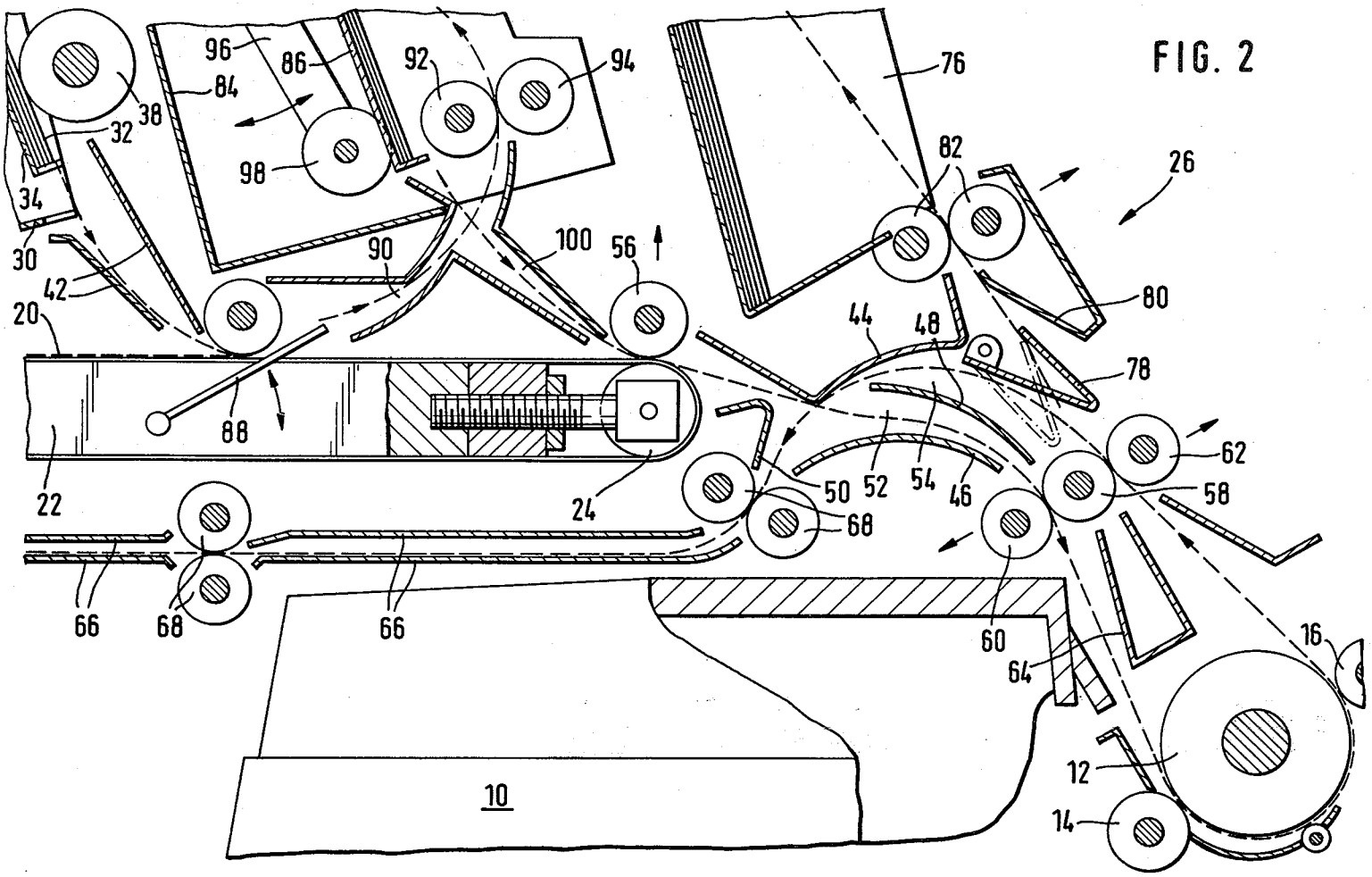
FIG. 2 shows the sheet guide of this apparatus in a larger scale than that of FIG. 1.

The sheet guide has an upper guide foil 44, a lower guide foil 46, a separation foil 48 disposed between these two, and a bent guide foil 50. An upwardly bent arm of the upper guide foil 44 forms, with the upper arm of the bent guide foil 50 located therebelow, a funnel which receives the single sheets which are fed by the conveyor belt 20 and by a pivotable counter roller 56 disposed at the end of the conveyor belt 20. From this funnel, the single sheets arrive, as is shown in FIG. 2 in broken lines and indicated by arrows, in an induction channel 52 which is formed by the lower guide foil 46 and the separation foil 48. The sheets then proceed through this induction channel 52 to a pair of advancement rollers comprising a driven roller 58 and a counter roller 60, which can be pivoted away and is freely rotatable. This roller pair 58, 60 takes on the task of further advancing the sheet to the induction gap between the printing cylinder 12 and the induction roller 14. There, during the printing process, the further advancement of the sheet is taken over by the printing cylinder 12.

The printed sheets exiting between the printing cylinder 12 and the ejection roller 16 proceeds through a pair of transport rollers comprising the driven roller 58 and a counter roller 62 which can be pivoted away and is freely rotatable. The counter rollers 60 and 62 come into contact with the roller 58, driven counterclockwise in FIG. 2, at diametrically opposed points, so that this roller 58 can bring about both the induction and the ejection of the sheet. A further guide foil 64 disposed between the advancement rollers 58, 60, 62 and the printing cylinder 12 forms with one of its arms a funnel which narrows from the roller pair 58, 60 toward the induction gap of the printing cylinder 12; with its other arm, it forms a funnel which narrows from the ejection gap of the printing cylinder 12 toward the roller pair 58, 62.

The sheet advanced by the pair of advancement rollers 58, 62 proceeds into an ejection channel 54, which travels above the induction channel 52 and is formed by the separation foil 48 and a concave portion of the upper guide foil 44. This ejection channel 54 crosses, from top to bottom, the induction channel 52 and discharges into a funnel which is formed by the lower arm of the vent guide foil 50 and the lower guide foil 46 and leads to the delivery track which will be described below.

The dimensions of the sheet guide 26 are selected to be such that the distance between the end of the conveyor belt 20 having the counter roller 56 and the pair of advancement rollers 58, 60; the distance between this pair of advancement rollers 58, 60 and the induction gap between the printing cylinder 12 and the induction roller 14; the distance between the ejection gap of the printing cylinder 12 and the ejection roller 16 and the pair of advancement rollers 58, 62; and finally the distance between this pair of advancement rollers 58, 62 and the first pair of conveyor rollers 68 of the delivery track are each of them smaller than the length of the individual sheets. In this manner, the advancement of the single sheets is assured over the entire area of the sheet guide. Furthermore, the dimensions of the sheet guide are selected to be such that they do not interfere with the sheet induced by the printing cylinder 12 and ejected thereby at the point of crossing of the induction channel 52 and the ejection channel 54.

The delivery track into which the printed single sheets are guided from the ejection channel 54 is disposed horizontally directly below the conveyor belt 20 and parallel thereto. The delivery track comprises pairs of guide foils 66 disposed above each other, the length of which is shorter than the length of the single sheets. Between each two pairs of these guide foils 66, there is a pair of conveyor rollers 68, one roller of each of which is driven. The single sheets are guided between the guide foils 66 and are advanced by the conveyor roller 68.

Stacking receptacles 70 are disposed one after another in the direction of delivery, substantially vertically, below the delivery track. The receptacles 70, as shown in FIG. 1, are disposed so as to form an acute angle in the direction opposite the direction of delivery by the delivery track.

Each stacking receptable 70 is assigned one diverter of the delivery track. This diverter comprises a section 72 of the upper guide foil which is pivotable downward and an associated exit gap of the lower guide foil which runs transverse to the direction of delivery, from whence a bent section 74 of the lower guide foil 66 leads to the appropriate stacking receptable 70.

The diverters are separately controllable by the office machine 10. If one of the diverters is controlled then, as shown for the right-hand stacking receptacle 70 in FIG. 1, the upper diverter section 72 is pivoted downward, so that it diverts the arriving single sheet from the delivery track into the exit slot disposed therebelow and the sheet is then guided by means of the section 74 leading downward into the appropriate stacking receptacle 70. The printed side of the sheet, which is uppermost in the delivery track, thus comes to rest on the bottom, because of the oblique disposition of the stacking receptacle 70, so that the sheets are stacked in the order in which they were printed.

In the event that a printed single sheet is not to be stacked in the stacking receptacle 70 but rather is to be immediately removed after printing, an additional vertical stacker 76 is provided above the sheet guide 26. A reversible diverter 78, which can clearly be seen in FIG. 2, is provided at the upper limitation of the ejection channel 54 between the pair of advancement rollers 58, 62 and the upper guide foil 44. This diverter 78, formed by a guide foil having the form of an acute angle, is pivotable between a position shown in solid lines in FIG. 2 and a position shown in broken lines in FIG. 2. In the position shown in solid lines, the diverter 78 forms one part of the ejection channel 54, which delivers the sheets advanced by the pair of advancement rollers 58, 62 to the delivery track.

If the diverter 78 is pivoted into the position shown in broken lines in FIG. 2, then it diverts the printed sheets arriving from the pair of advancement rollers 58, 62 upward into a funnel pointing upward which is formed by a bent arm of the upper guide foil 44 and an additional guide foil 80. The sheets are guided by this funnel between a pair of advancement rollers 82, one roller of which is driven, while the other roller is embodied as a counter roller which can be pivoted away and is freely rotatable. The advancement rollers 82 undertake the advancement of the single sheets from the pair of advancement rollers 58, 62 and eject the printed sheets into the stacker 76, where they can be stacked, with the printed side visible, or can be removed.

In order to be able to put together a plurality of identical or different single sheets stored in the cassettes 30 to make up a set of forms, which will then be printed in common, an assembly unit 84 is provided above the conveyor belt 20 ahead of the cassette holder unit 28 nearest the printing cylinder, which in FIG. 1 is on the right-hand side. The assembly unit 84 has a substantially vertical sheet stacker 86, which comprises two or more parallel vertical rails the lower end of which are bent for the purpose of seating the sheets, as can be seen in FIG. 2.

A diverter 88 supported in the support plate 22 is pivotable upward into the path of the conveyor belt 20, as is shown in FIG. 2. The single sheets arriving from the cassettes 30 are guided upward by this diverter 88 into a funnel-like chute 90 and from there between a pair of advancement rollers 92, 94. The advancement roller 92 is drivable counterclockwise in FIG. 2, while the advancement roller 94 is embodied as a freely rotatable counter roller. The single sheets arriving from the cassettes 30 are ejected by the pair of advancement rollers 92, 94 into the sheet stacker 86, so that the desired set of forms can be put together there.

Once the single sheets have been collected from the cassettes 30 in the desired number and order in the sheet stacker 86, then a dispenser element 96 supported in the assembly unit 84 and comprising a lever with a roller 98 supported freely rotatably at its forward end is pivoted from the rear against the sheet stacker 86. The roller 98 then grips between the vertical rails of the sheet stacker 86, lifts the set of forms collected there out of the sheet stacker 86 and presses it against the advancement roller 92. Because the advancement roller 92 is driven counterclockwise, the set of forms is delivered downward into a dispenser chute 100. The dispenser chute 100 conveys the set of forms between the forward end of the conveyor belt 20 and the pivotable counter roller 56. From there, the set of forms proceeds into the induction chute 52. The set of forms is kept together, by means of the rollers 92, 98, the conveyor belt 20 and the roller 56 and by the pair of advancement rollers 58, 60, so that slippage of individual sheets within the set of forms is prevented.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. An apparatus for feeding single sheets from a magazine to the printing cylinder of a printing office machine or data processing machine and for stacking the single sheets arriving from the printing cylinder, wherein the improvement comprises:

a feed-in conveyor track (20) disposed substantially horizontally and leading to said printing cylinder (12);

at least two substantially vertical magazine units (30);

which are disposed above said feed-in conveyor track (20) one after another in the direction of feed of sheets to the printing cylinder and provided with separately controllable separation devices (38);

a delivery track (66, 68) disposed below said feed-in conveyor track (20) and leading away from said printing cylinder (12);

which are disposed below said delivery track one after another in the direction of delivery from the printing cylinder;

separately controllable delivery diverters (72) assigned to said stacking units (70) and provided in said delivery track (66, 68);

and a sheet guide (26) with an induction channel (52) leading from said feed-in conveyor track (20) to the induction side of said printing cylinder (12) and an ejection channel (54) leading from the ejection side of said printing cylinder to said delivery track (66, 68), said ejection channel crossing said induction channel (52).

2. An apparatus as claimed in claim 1, further wherein said feed-in conveyor track (20) is an endless conveyor belt revolving in driven fashion.

3. An apparatus as claimed in claim 2, further wherein said magazine units (30) are interchangeable cassettes.

4. An apparatus as claimed in claim 3, further wherein said cassettes (30) are each insertable in cassette holder units (28) separately insertable into the apparatus, said cassette holder units (28) containing said separation device (38) and its drive means.

5. An apparatus as claimed in claim 4, further wherein the drive of said separation devices (38) is effected by means of said feed-in conveyor track (20) via a gear provided in said cassette holder unit (28) and having a controllable coupling or by means of a separately controllable motor provided in each of said cassette holder units (28).

6. An apparatus as claimed in claim 5, further wherein said delivery track comprises guide foils (66) with driven conveyor rollers (68).

7. An apparatus as claimed in claim 6, further wherein said stacking units (70) are stacking receptacles.

8. An apparatus as claimed in claim 7, further wherein said stacking receptacles (70) are disposed at an acute angle counter to the delivery direction of said delivery track (66, 68).

9. An apparatus as claimed in claim 8, further wherein driven advancement rollers (58, 60, 62) are provided in said induction channel (52) and in said ejection channel (54) of said sheet guide (26).

10. An apparatus as claimed in claim 9, further wherein one of said advancement rollers (58) is common to said induction channel (52) and said ejection channel (54) and engages said channels with diametrically opposed areas of its circumference.

11. An apparatus as claimed in claim 10, further wherein an additional stacker (76) is provided above said printing cylinder (12) and a diverter (78) is provided in said ejection channel (54) of said sheet guide (26), said diverter (78) connecting said ejection side of said printing cylinder (12) reversibly to said stacker (76).

12. An apparatus as claimed in claim 11, further wherein said additional stacker (76) has driven advancement rollers (82).

13. An apparatus as claimed in claim 12 further wherein an assembly unit (84) is disposed ahead of the magazine unit (30) nearest said printing cylinder (12), a diverter (88) is provided in said feed-in conveyor track (20) which reversibly connects said feed-in conveyor track to said assembly unit (84), and said assembly unit (84) has a dispenser chute (100) which leads to said feed-in conveyor track (20) or to said induction channel (52) of said sheet guide (26).

14. An apparatus as claimed in claim 13, further wherein said assembly unit (84) has a substantially vertical sheet stacker (86) and a dispenser element (96) is disposed behind said sheet stacker (86), which is movable from the rear into said sheet stacker (86) in order to lift the sheets located there out of said sheet stacker.

15. An apparatus as claimed in claim 14, further wherein said assembly unit (84) has driven advancement rollers (92, 94).

16. An apparatus as claimed in claim 14 or 15, further wherein said dispenser element (96) has a freely rotatable roller (98) arriving from the rear to contact the sheets located in said sheet stacker (86), said roller (98) pressing said sheets against said driven transport roller (92).

* * * * *